US009896161B2

(12) United States Patent
Yun et al.

(10) Patent No.: US 9,896,161 B2
(45) Date of Patent: Feb. 20, 2018

(54) LOCKING DEVICE FOR A DAMPING APPARATUS FOR A MOON POOL

(71) Applicants: DAEWOO SHIPBUILDING & MARINE ENGINEERING CO., LTD., Seoul (KR); Transocean Sedco Forex Ventures Limited, George Town, Grand Cayman (KY)

(72) Inventors: Hae Sung Yun, Geoje-si (KR); Gurbachan Virk, Pleasanton, CA (US)

(73) Assignees: DAEWOO SHIPBUILDING & MARINE ENGINEERING CO., LTD., Seoul (KR); TRANSOCEAN SEDCO FOREX VENTURES LIMITED, Grand Cayman (KY)

( * ) Notice: Subject to any disclaimer, the term of this patent is extended or adjusted under 35 U.S.C. 154(b) by 0 days.

(21) Appl. No.: 15/379,381

(22) Filed: Dec. 14, 2016

(65) Prior Publication Data

US 2017/0096192 A1 Apr. 6, 2017

Related U.S. Application Data

(63) Continuation of application No. 13/877,145, filed as application No. PCT/KR2011/004801 on Jun. 30, 2011, now abandoned.

(30) Foreign Application Priority Data

Sep. 29, 2010 (KR) ..... 10-2010-0094027

(51) Int. Cl.
*B63B 3/14* (2006.01)
*B63B 17/00* (2006.01)
(Continued)

(52) U.S. Cl.
CPC ..... *B63B 3/54* (2013.01); *B63B 3/14* (2013.01); *B63B 17/00* (2013.01); *B63B 19/00* (2013.01);
(Continued)

(58) Field of Classification Search
CPC ..... B63B 2003/147; B63B 3/14; B63B 3/54; B63B 17/00; B63B 19/00; B63B 19/12;
(Continued)

(56) References Cited

U.S. PATENT DOCUMENTS 988,455 A 4/1911 Gee
1,086,749 A 2/1914 Brenneman
(Continued)

FOREIGN PATENT DOCUMENTS

DE 103 10 640 A1 9/2004
FR 2 868 459 A1 10/2005
(Continued)

OTHER PUBLICATIONS

International Search Report dated Feb. 21, 2012 of PCT/KR2011/004801 which is the parent application—2 pages.

*Primary Examiner* — Ajay Vasudeva
(74) *Attorney, Agent, or Firm* — Knobbe Martens Olson & Bear, LLP

(57) ABSTRACT

Provided is a locking apparatus for a damping device of a moonpool, which can automatically lock and unlock an opened state of the damping device of the moonpool. The locking apparatus includes: one or more first locking members installed in a sidewall of the moonpool; one or more second locking members installed in a side of the damping device; and a holding unit separably holding the first locking members and the second locking members when the damping devices are in the opened state.

5 Claims, 2 Drawing Sheets

(51) Int. Cl.
*B63B 19/14* (2006.01)
*B63B 3/54* (2006.01)
*B63B 19/00* (2006.01)

(52) U.S. Cl.
CPC ..... *B63B 19/14* (2013.01); *B63B 2003/147* (2013.01)

(58) Field of Classification Search
CPC ..... B63B 19/14; B63B 19/19; B63B 19/197; B63B 19/203; B63B 35/03; B63B 35/04
See application file for complete search history.

(56) References Cited

U.S. PATENT DOCUMENTS

| | | | |
|---|---|---|---|
| 1,497,718 | A | 6/1924 | Gilland |
| 1,602,264 | A | 10/1926 | Hutchison |
| 1,768,021 | A | 6/1930 | Bauerband |
| 1,834,678 | A | 12/1931 | Bryant |
| 1,944,382 | A | 1/1934 | Wecker |
| 2,358,914 | A | 9/1944 | Dray |
| 2,940,790 | A | 6/1960 | Ingalls et al. |
| 3,166,144 | A | 1/1965 | Price |
| 3,533,652 | A | 10/1970 | Crane et al. |
| 3,751,086 | A | 8/1973 | Geringer |
| 4,615,548 | A | 10/1986 | McGee |
| 4,659,121 | A | 4/1987 | McGee |
| 4,866,963 | A | 9/1989 | Leininger et al. |
| 5,092,637 | A | 3/1992 | Miller |
| 5,351,512 | A | 10/1994 | Pearlman |
| 5,427,422 | A | 6/1995 | Madlener et al. |
| 7,017,958 | B1 | 3/2006 | Bowers |
| 8,250,811 | B2 | 8/2012 | Zijlstra |
| 8,690,201 | B2 | 4/2014 | Frazier |
| 8,708,378 | B2 | 4/2014 | Frazier |
| 8,955,596 | B2 * | 2/2015 | Yun ..... B63B 19/28 114/264 |
| 2013/0300135 | A1 * | 11/2013 | Yun ..... E05C 1/08 292/144 |
| 2015/0115622 | A1 | 4/2015 | Burdenko et al. |

FOREIGN PATENT DOCUMENTS

| | | | | |
|---|---|---|---|---|
| JP | 2001-071989 | A | | 3/2001 |
| JP | 2012091630 | A | * | 5/2012 |
| KR | 10-0246516 | B1 | | 4/2000 |
| KR | 10-2010-0069983 | A | | 6/2010 |
| KR | 20-2010-0007184 | | | 7/2010 |

* cited by examiner

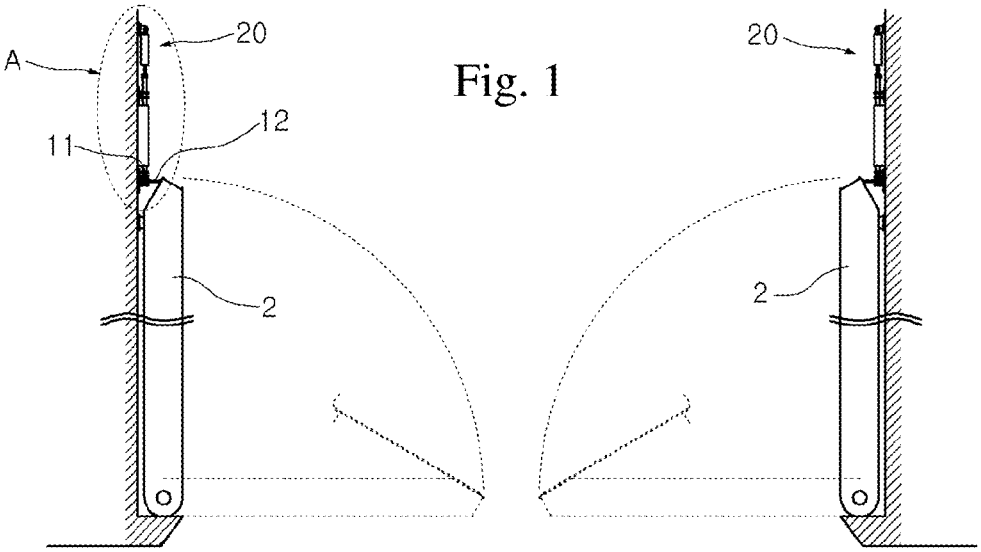
Fig. 1
Fig. 3
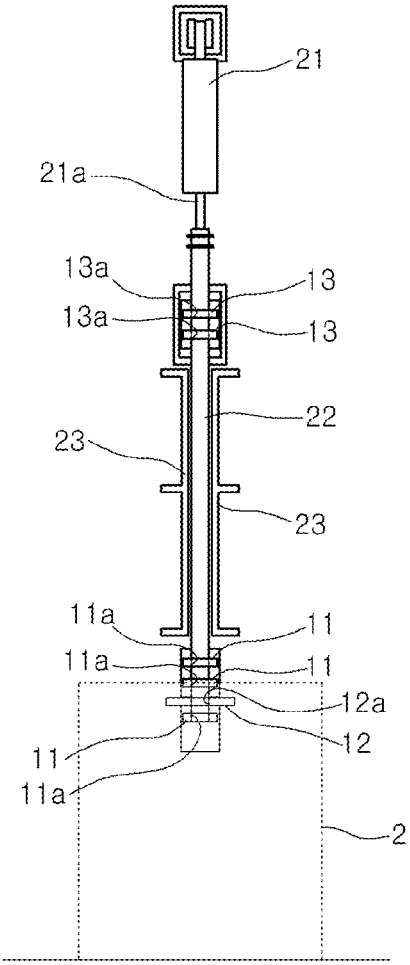

LOCKING DEVICE FOR A DAMPING APPARATUS FOR A MOON POOL

CROSS-REFERENCE(S) TO RELATED APPLICATION

This application is a continuation application of U.S. patent application Ser. No. 13/877,145 filed Jul. 17, 2013, now abandoned, which claims priority to and the benefit of Korean Patent Application No. 10-2010-0094027, filed on Sep. 29, 2010, the disclosures of which are incorporated herein by reference in their entirety.

BACKGROUND OF THE INVENTION

Field of the Invention

The present invention relates to a damping device of a moonpool, and more particularly, to a locking apparatus for a damping device of a moonpool, which can automatically lock or unlock an opened state of the damping device of the moonpool.

Description of the Related Art

With the development of offshore drilling techniques, drill ships equipped with drilling equipment suitable for development of small marginal fields or deep-sea oil fields have been developed.

In a conventional offshore drilling, rig ships or fixed type platforms have been mainly used, which can be moved only by tugboats and are anchored at a position on the sea using a mooring gear to conduct an oil drilling operation. In recent years, however, so-called drill ships have been developed and used for offshore drilling The drill ships are provided with advanced drilling equipments and have structures similar to typical ships such that they can make a voyage using their own power. Since drill ships have to frequently move in order for development of small marginal fields, they are constructed to make a voyage using their own power, without assistance of tugboats.

Meanwhile, a moonpool through which a variety of equipments for a drilling operation pass is installed in an offshore platform such as a drill ship or a drill rig. In order to couple a riser, a moonpool may also be installed in a ship such as an LNG-RV and offshore platforms such as LNG FPSO, oil FPSO or LNG FSRU. The moonpool has a hollow parallelepiped or cylindrical structure through which a variety of equipments are vertically moved between an upper deck and a bottom of an offshore platform.

As the size of an offshore platform increases, a moonpool also becomes larger. Accordingly, in the case of a parallelepiped moonpool, a large moonpool with a size of 12-13 m (a length in a width direction of an offshore platform)×14-25 m (a length in a front and rear direction of an offshore platform) has been used. Such a moonpool is indispensable in terms of the purpose of a drill ship, but is very disadvantageous in terms of anchoring of the ship, voyage stability and voyage performance of the ship.

In particular, a sloshing phenomenon is induced by a relative movement between seawater flowing into the moonpool and seawater outside the hull of the ship. The sloshing phenomenon may cause an increase in voyage resistance, a decrease in voyage speed, an increase in power consumption and fuel consumption, and a damage of a hull.

In addition, an overflowing phenomenon is induced by a fluid movement inside the moonpool. The overflowing phenomenon may serve as a factor that deteriorates a worker's safety and work efficiency.

Accordingly, a damping device which opens and closes the moonpool is installed in order to minimize the movement resistance of the hull and effectively prevent the overflowing phenomenon caused by high waves. One or two damping devices are hinged to a sidewall of the moonpool to open and close the moonpool. Driving wires are coupled to the damping devices such that the opening and closing operation of the damping devices is carried out.

Meanwhile, in the case where such a damping device is not used, that is, the damping device maintains an opened state, a worker has climbed down a ladder to reach a storage position and then locks the opened state of the damping device by turning a locking lever.

As described above, since the locking and unlocking operation of the conventional damping device is carried out by a worker's action that manually locks and unlocks the opened state of the damping device, a worker is in danger of falling and the locking and unlocking operation is very inconvenient.

SUMMARY OF THE INVENTION

An aspect of the present invention is directed to a locking apparatus for a damping device of a moonpool, which can automatically lock and unlock an opened state of a damping device of a moonpool.

According to an embodiment of the present invention, a locking apparatus for a damping device of a moonpool, which automatically locks and unlocks one or more damping devices opening and closing the moonpool in an opened state, includes: one or more first locking members installed in a sidewall of the moonpool; one or more second locking members installed in a side of the damping device; and a holding unit separably holding the first locking members and the second locking members when the damping devices are in the opened state.

The first locking member may have one or more first locking holes, and the second locking member may have one or more second locking holes.

The first locking member may be installed in a sidewall of the moonpool adjacent to an end of the damping device when the damping device is in the opened state, the second locking member may be installed at the end of the damping device, and the first locking member and the second locking member may be disposed not to be interfered with each other when the damping device is in the opened state.

The holding unit may include: a driving cylinder disposed on the first locking member; and a holding shaft installed to be vertically movable by the driving cylinder, such that the holding shaft moves vertically and is inserted into or released from the first and second locking holes when the first locking hole of the first locking member and the second holding hole of the second holding member are matched with each other, whereby the holding unit separably holds the first locking member and the second locking member.

The locking apparatus may further include one or more guide members above the first locking member, wherein the guide members have guide holes.

The locking apparatus may further include a pair of regulation plates on left and right sides of the holding shaft.

According to another embodiment, a locking apparatus for a damping device of a moonpool, which automatically locks and unlocks one or more damping devices opening and closing the moonpool, is characterized in that, when the damping device is in an opened state, the damping device is automatically unlockably held at a storage position of the moonpool.

BRIEF DESCRIPTION OF THE DRAWINGS

FIG. 1 is a view illustrating a locking apparatus for a damping device of a moonpool according to an embodiment of the present invention.

FIG. 3 is a plan view looked in a direction of an arrow B of FIG. 2.

DETAILED DESCRIPTION OF EXEMPLARY EMBODIMENTS

Figure 2:
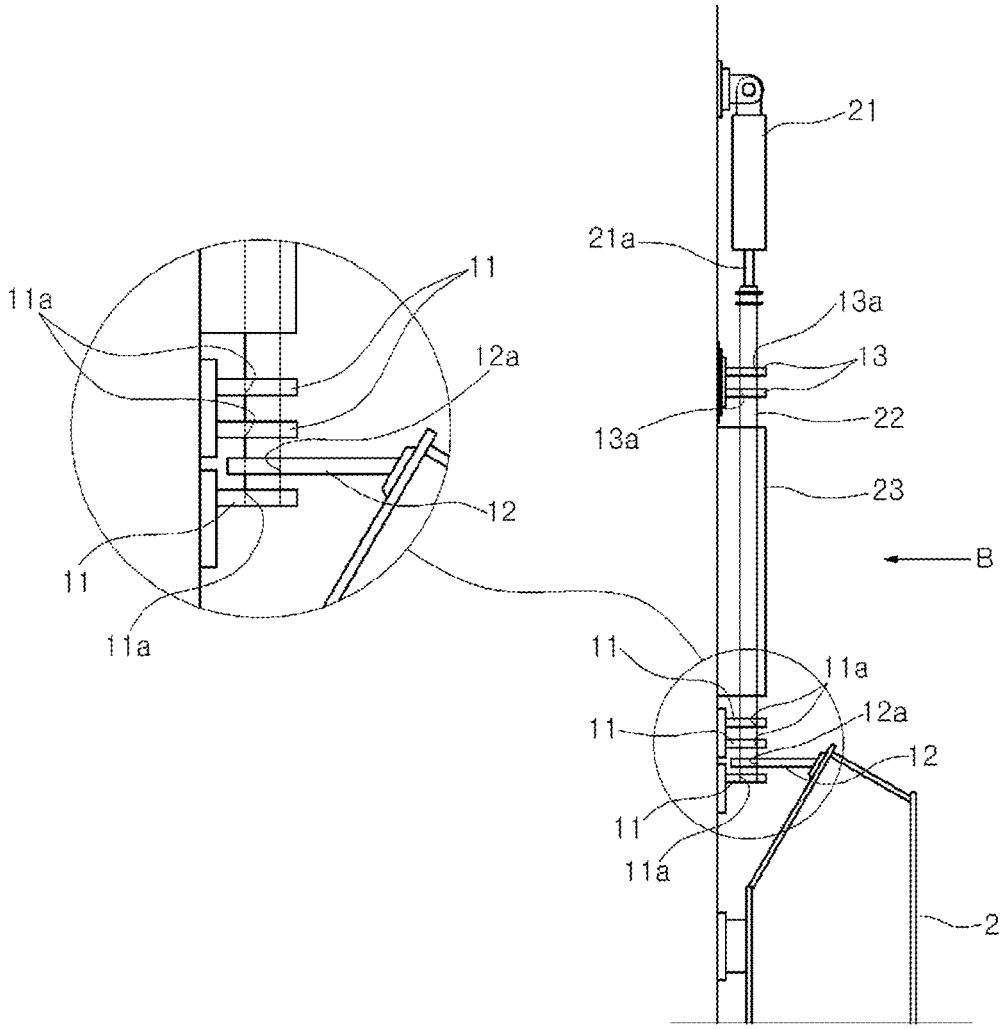
FIG. 2 is an enlarged view illustrating a portion indicated by an arrow A of FIG. 1.

Exemplary embodiments of the present invention will be described below in detail with reference to the accompanying drawings. Throughout the disclosure, like reference numerals refer to like parts throughout the various figures and embodiments of the present invention.

FIGS. 1 to 3 illustrate a locking apparatus for a damping device, configured as moonpool door, according to an embodiment of the present invention.

As illustrated in FIG. 1, a locking apparatus for a damping device of a moonpool according to the present invention may be applied to a moonpool structure in which one or more damping devices 2 are pivotally installed in a sidewall of a moonpool to open and close the moonpool.

FIG. 1 exemplarily illustrates a structure in which a pair of damping devices 2, which are configured as a pair of moonpool doors, opens and closes the moonpool, and the locking apparatus of the present invention is installed corresponding to the respective damping devices 2. To open and close the moonpool, a pair of damping devices may be installed as illustrated in FIG. 1, or only one damping device may be installed. In either case, the opening and closing operation of the damping device may be carried out in a front and rear direction or a left and right direction of a hull.

The locking apparatus for the damping device of the moonpool according to the embodiment of the present invention includes one or more first locking members 11 installed in a sidewall of the moonpool, one or more second locking members 12 installed in a side of the damping device 2, and a holding unit 20 unlockably holding the first locking members 11 and the second locking members 12 when the damping devices 2 are in the opened state.

The first locking member 11 is installed in a sidewall of the moonpool. FIGS. 2 and 3 exemplarily illustrate the installation of three first locking members 11. The first locking member 11 has a first locking hole 11*a*.

The second locking member 12 is installed in a side of the damping device 2. FIGS. 2 and 3 exemplarily illustrate the installation of one second locking member 12. The second locking member 12 has a second locking hole 12*a*. As illustrated is FIGS. 1 and 2, the second locking member 12 is attached to a slanted portion at a top of the damping device 2. The slanted portion provides a space between the moonpool sidewall and the top of the damping device 2 when the damping device 2 is in its open position standing against the sidewall.

According to one embodiment, the first locking member 11 is installed in a sidewall of the moonpool adjacent to the end of the damping device 2 when the damping device 2 is in an opened state, and the second locking member 12 is installed in the end of the damping device 2. As illustrated in FIGS. 2 and 3, when the damping device 2 is in the opened state, the first and second locking members 11 and 12 are disposed alternately such that they are not inferred with each other. Meanwhile, FIGS. 2 and 3 exemplarily illustrate the installation of three first locking members 11 and one second locking member 12.

Due to such a structure, the second locking member 12 of the damping device 2 is positioned such that it is inserted between the first locking members 11 of the moonpool when the damping device 2 is opened. In this case, the first and second locking holes 11*a* and 12*a* may be arranged in a straight line.

In this embodiment, the state in which the damping device 2 is opened refers to a state in which the damping device 2 is rotated to the sidewall of the moonpool. This means that the damping device 2 is located at a storage position of the moonpool in order not to use the damping device 2.

The holding unit 20 is configured to separably hold the first and second locking members 11 and 12 such that the opened state of the damping device 2 is unlockably locked.

The holding unit 20 according to one embodiment of the present invention includes a driving cylinder 21 which is installed at an upper portion of the first locking member 11, and a holding shaft 22 which is vertically movable by the driving cylinder 21.

The driving cylinder 21 is installed in a sidewall of the moonpool. One end of the driving cylinder 21 may be pivotally hinged to the sidewall of the moonpool.

An upper portion of the holding shaft 22 is coupled to a lower portion of a driving rod 21*a* of the driving cylinder 21. Accordingly, when the driving rod 21*a* of the driving cylinder 21 is operated, the holding shaft 22 is vertically movable.

Due to such a structure, when the damping device 2 is opened and the first and second locking holes 11*a* and 12*a* are matched with each other, the holding shaft 22 may move vertically along the first and second locking holes 11*a* and 12*a* and separably hold the first and second locking members 11 and 12.

Meanwhile a pair of regulation plates 23 is installed on left and right sides of the holding shaft 22. The regulation plates 23 prevent the holding shaft 22 from being released to left and right.

In addition, one or more guide members 13 are installed above the first locking member 11, and the guide members 13 have guide holes 13*a*. The holding shaft 22 can ensure the precision of the upward/downward movement along the guide holes 13*a* of the guide members 13.

A remote controller (not shown) is coupled to the driving cylinder 21. The driving of the driving cylinder 21 is controlled by the remote controller (not shown). Accordingly, the opened state of the damping device 2 can be automatically locked and unlocked.

According to the present invention, the opened state of the damping device 2 can be automatically locked and unlocked by the locking members 11 and 12 and the holding unit 20 that separably hold the locking members 11 and 12. As compared to the conventional passive method, a worker is not in danger of falling and the locking and unlocking operation is very convenient.

While the embodiments of the present invention has been described with reference to the specific embodiments, it will be apparent to those skilled in the art that various changes and modifications may be made without departing from the spirit and scope of the invention as defined in the following claims.

What is claimed is:

1. A marine structure comprising:

a moonpool comprising a sidewall and a moonpool opening for accessing water under the marine structure;

a locking shaft arranged generally along a vertical direction;

an actuator configured to cause the locking shaft to move back and forth along the vertical direction;

a pair of guide plates attached to the sidewall and extending in parallel along the vertical direction with an elongated gap therebetween for accommodating a mid-portion of the locking shaft within the elongated gap;

a through-hole guide member attached to the sidewall above the guide plates in the vertical direction and comprising a through-hole configured to pass the locking shaft therethrough;

a moonpool door connected to the sidewall and configured to hingedly move between an open position and a close position, wherein the door is configured to stand against the sidewall at the open position and to face water at the close position;

the moonpool door comprising a slanted top located at the moonpool door's top and slanted relative to the sidewall to provide a space between the sidewall and the slanted top when the moonpool door is at its open position standing against the sidewall; and a through-hole lock member comprising a through-hole and attached to the slanted top of the door, wherein when the moonpool door is at its open position standing against the sidewall, the through-hole of the through-hole lock member becomes aligned with the through-hole of the through-hole guide member along the vertical direction such that the through-hole of the through-hole lock member receives a tip portion of the locking shaft below the guide plates in the vertical direction.

2. The marine structure of claim 1, wherein the through-hole guide member attached to the sidewall above the guide plates is referred to as a first through-hole guide member, wherein the marine structure further comprises a second through-hole guide member attached to the sidewall below the guide plates and comprising a through-hole configured to pass the locking shaft therethrough.

3. The marine structure of claim 2, wherein the second through-hole guide member is located above the through-hole lock member when the moonpool door is at its open position standing against the sidewall.

4. The marine structure of claim 2, wherein the second through-hole guide member is located below the through-hole lock member when the moonpool door is at its open position standing against the sidewall.

5. The marine structure of claim 2, wherein the second through-hole guide member is located in the space provided between the sidewall and the slanted top when the moonpool door is at its open position standing against the sidewall.

* * * * *